US007874457B2

(12) United States Patent
Sowers et al.

(10) Patent No.: US 7,874,457 B2
(45) Date of Patent: Jan. 25, 2011

(54) ICE BUCKET DISPENSER APPARATUS

(76) Inventors: Charles L. Sowers, 414 Bethel Dr., Salisbury, NC (US) 28144; William Frank Buckminster, 287 Harbortown Dr., Taylorsville, NC (US) 28681

( * ) Notice: Subject to any disclaimer, the term of this patent is extended or adjusted under 35 U.S.C. 154(b) by 714 days.

(21) Appl. No.: 11/977,695

(22) Filed: Oct. 25, 2007

(65) Prior Publication Data

US 2009/0107166 A1 Apr. 30, 2009

(51) Int. Cl.
*B67D 7/06* (2010.01)

(52) U.S. Cl. ..... 222/108; 222/146.6; 222/185.1; 222/408.5; 222/508; 222/517; 62/344; 62/459; 62/462; 62/464; 141/362

(58) Field of Classification Search ..... 222/108, 222/146.6, 185.1, 508, 517, 183, 226, 228, 222/243, 247, 248, 408.5; 62/344, 371, 457.1–457.8, 62/459, 462, 464; 141/351, 357, 360, 362
See application file for complete search history.

(56) References Cited

U.S. PATENT DOCUMENTS

| | | | | |
|---|---|---|---|---|
| 264,186 | A | 9/1882 | Miller | |
| 297,887 | A | 4/1884 | Watson | |
| 2,644,614 | A * | 7/1953 | Kalman et al. | 222/146.5 |
| 3,217,940 | A * | 11/1965 | Fahn et al. | 222/183 |
| 3,983,583 | A | 10/1976 | Herman et al. | |
| 4,090,641 | A | 5/1978 | Lindenschmidt | |
| 4,102,660 | A | 7/1978 | Beckett et al. | |
| 4,123,918 | A | 11/1978 | Kohl et al. | |
| 4,164,327 | A | 8/1979 | Clark | |
| 4,498,607 | A | 2/1985 | Jaschinski | |
| 4,789,106 | A | 12/1988 | Weber | |
| 4,997,109 | A | 3/1991 | Carper | |
| 5,279,445 | A | 1/1994 | Fisher et al. | |
| 5,392,694 | A | 2/1995 | Muller et al. | |
| 5,553,744 | A | 9/1996 | Sawyer, III | |
| 6,213,340 | B1 | 4/2001 | Gehant | |
| 6,305,177 | B1 | 10/2001 | Edwards et al. | |
| 6,651,449 | B2 | 11/2003 | Heims et al. | |
| 6,688,133 | B1 * | 2/2004 | Donefrio | 62/372 |
| D488,355 | S | 4/2004 | Irvine | |
| 6,758,047 | B1 | 7/2004 | Giles | |
| 6,880,358 | B2 | 4/2005 | Lucas et al. | |
| 7,013,833 | B2 | 3/2006 | Lemberger et al. | |
| 7,065,975 | B1 | 6/2006 | Herndon et al. | |
| D530,156 | S | 10/2006 | Moore | |
| 2002/0020711 | A1 | 2/2002 | Glass et al. | |
| 2004/0163405 | A1 | 8/2004 | Jung | |
| 2006/0027599 | A1 | 2/2006 | Edwards et al. | |

(Continued)

*Primary Examiner*—J. Casimer Jacyna

(57) ABSTRACT

A portable ice bucket apparatus for storing and dispensing ice includes: (a) an upper bucket portion including an insulated bucket with an opening at the top of the bucket and an ice body chute opening in a bottom wall of the bucket; (b) a motorless lower stand portion, the upper bucket portion being detachably attachable to the stand portion; (c) a dispensing mechanism including a movable gate flap within the bucket portion, a spring-loaded lever, and a gate shaft and a dispensing lever within the stand portion, the dispensing lever being coupled to the gate shaft, the gate shaft being coupled to the spring-loaded lever, the gate shaft being coupled with the gate flap; and (d) a water drainage and collection mechanism including a reservoir in the stand portion, and preferably a drain valve; wherein the movable gate flap in a closed position substantially covers the ice body chute opening.

20 Claims, 8 Drawing Sheets

U.S. PATENT DOCUMENTS

2007/0074795 A1 4/2007 Moore
2007/0084230 A1 4/2007 Krause et al.
2007/0119516 A1 5/2007 Heger et al.

* cited by examiner

ICE BUCKET DISPENSER APPARATUS

CROSS REFERENCE TO RELATED DOCUMENT

This invention was described in Disclosure Document Number 612225, which was received by the U.S. Patent & Trademark Office on Jan. 30, 2007.

BACKGROUND OF THE INVENTION

1. Technical Field

The present invention relates to a portable, manually operated, countertop bucket apparatus for storing and dispensing ice cubes and the like.

2. Background Information

Though conventional ice buckets are useful, particularly during a party, in that they avoid repeated trips by multiple users to the refrigerator/freezer, there are some problems attendant with the traditional ice bucket. First, the user's hands can become cold, wet, and uncomfortable from contact with the ice. This is often a particular problem for the hostess/server. Second, melt water from the ice and ice bucket often drips onto the user's clothes, the surrounding floor, etc., which is particularly disadvantageous during a party. Third, since many people place their hands or used cups into the ice bucket to scoop up ice, the ice and the inside of the bucket may become unsanitary. Both of the user's hands are usually occupied in this endeavor: one hand to hold the glass and one to scoop ice. Fourth, melted ice water on the floor can on occasion pose a safety hazard. Also, it is difficult, if not impossible, to scoop ice out of a conventional ice bucket with a long utensil without having to tilt the bucket.

With the ice bucket dispensing apparatus of the present invention, ice cubes and other ice bodies can be dispensed into a drinking glass or other receptacle without user contact with the ice. Using the present invention, ice bodies are dispensed from an upper bucket portion of the apparatus into a drinking glass or other receptacle positioned in a dispensing alcove in a lower dispenser portion of the apparatus. The drinking glass or other receptacle is pushed against a push lever on the ice bucket dispenser assembly, which causes ice cubes to be dispensed into the receptacle. This can be done one-handed. With the present apparatus, the bucket need not be uncovered as often, hence airborne bacteria and viruses are less likely to enter the bucket.

Also, the problem of melt water dripping from the ice bucket is solved by the ice melt drainage/collection system of the present invention. This both maintains sanitary conditions and protects the user. The users' hands need not be exposed to cold ice, and melt water is prevented from dripping onto the users' clothes and the floor, so safety issues are unlikely to occur. The apparatus of the present invention is useful for home use, as well as use in other locations, such as an outdoor picnic, at the office, etc.

BRIEF SUMMARY OF THE INVENTION

The present invention is a portable bucket apparatus for storing and dispensing ice bodies, such as ice cubes, that is ordinarily placed on a countertop or any other relatively flat surface for use. The ice bucket dispensing apparatus comprises: (a) an upper bucket portion comprising an insulated bucket with an opening at the top of the bucket and an ice body chute opening in a bottom wall of the bucket; (b) a motorless lower stand portion, the upper bucket portion being detachably attachable to the lower stand portion; (c) a dispensing mechanism comprising a movable gate flap within the upper bucket portion, a spring-loaded lever, and a gate shaft and a dispensing lever within the stand portion, the dispensing lever being coupled to the gate shaft, the gate shaft being coupled to the spring-loaded lever, the gate shaft being coupled with the gate flap; and (d) a water drainage and collection mechanism comprising a reservoir in the stand portion. In a closed position, the movable gate flap substantially covers the ice body chute opening. Preferably, a drain valve extends through the opening in the bottom wall of the upper bucket portion. The drain valve is in an open position when the upper bucket portion is attached to the stand portion, and in a closed position when the upper bucket portion is not attached to the stand portion. The ice bucket dispensing apparatus is not connected to a refrigeration unit, or a source of electricity.

Thus, the present invention conveys a number of advantages as noted herein, including: (1) it requires only one hand to operate; (2) it collects water from melted ice; (3) ice is kept sanitary; (4) no motor is required; (5) the ice falls into the drinking glass or other receptacle by gravity as there are few moving parts to malfunction; and (6) it can easily be dismantled for cleaning.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
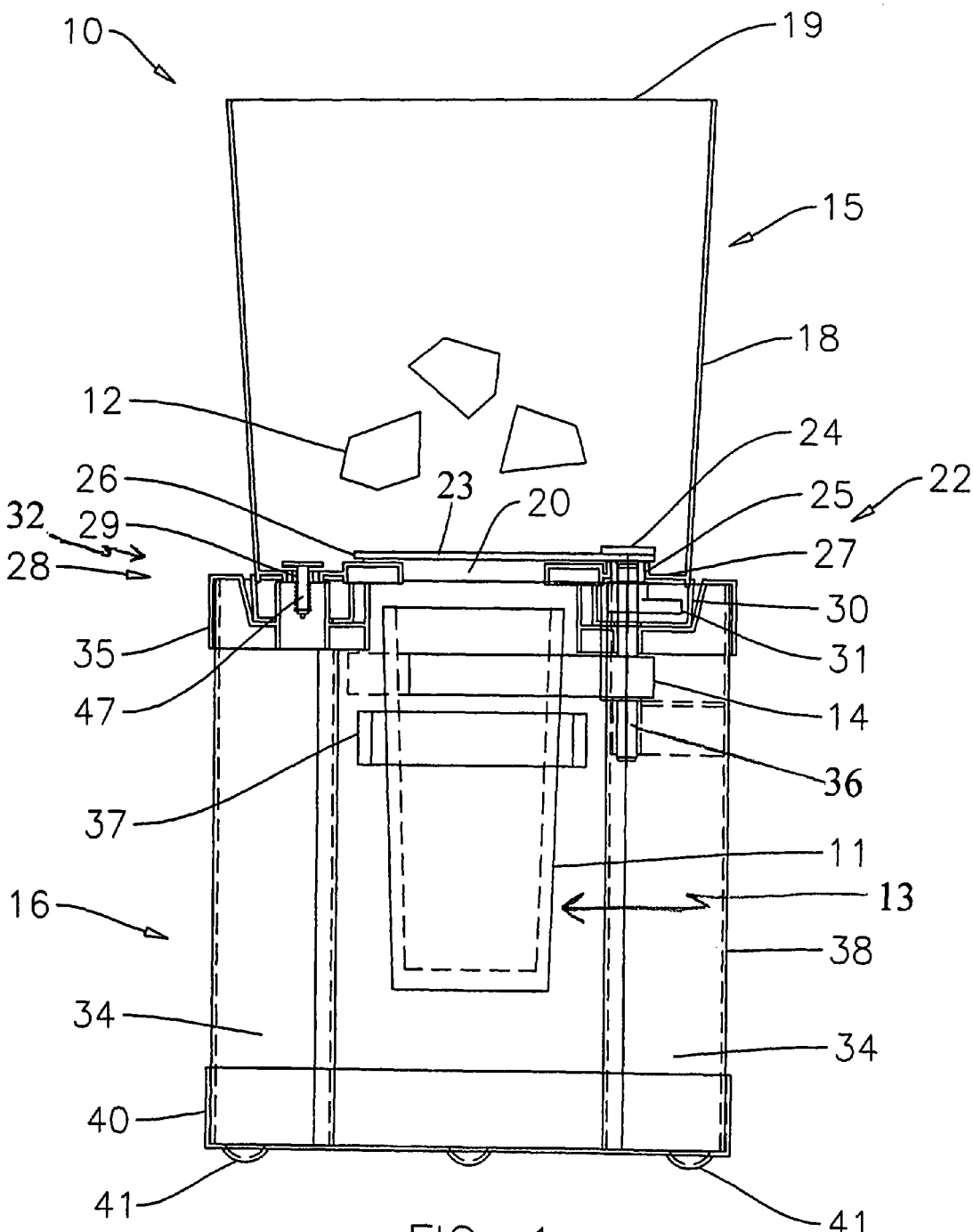
FIG. 1 shows a cross-sectional view from the front of an ice bucket dispenser apparatus according to the present invention, shown with a drinking glass.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Turning first to FIG. 1, a portable, countertop ice bucket dispenser apparatus 10 according to the present invention dispenses ice bodies 12 into a drinking glass, cup, tumbler, pitcher, or other receptacle 11 for receiving ice. The countertop ice bucket dispenser apparatus 10 is intended to be placed on a countertop or any convenient, relatively flat surface, and is not intended for attachment to a refrigerator or freezer unit. The word "countertop" is meant to include counters in a house, the tops of tables, wet bars, bars, buffets, kitchen islands, etc. Once the ice bucket dispenser apparatus 10 is set up on a table or the like and filled with ice cubes, the user places the drinking glass or other suitable receptacle 11 in the ice dispensing alcove 13 and pushes the back of the drinking glass against the dispensing lever 14 in order to dispense the ice bodies 12 from the ice bucket dispenser apparatus 10 into the glass 11. Ice cubes are thus transferred without the user having to contact the ice. This both maintains sanitary conditions and protects the user. The users' hands need not be exposed to cold ice, and ice melt is prevented from dripping onto the users' clothes and the floor. The ice bodies 12 may be ice cubes, ice chips, or other pieces or forms of ice.

Referring to FIGS. 1 through 4, the ice bucket dispenser apparatus 10 comprises an upper bucket portion 15 and a lower dispensing stand portion 16. A lower part of the upper bucket portion 15, which holds the ice bodies 12, mates with an upper part of the lower stand portion 16. The components of the ice bucket dispenser apparatus are made of molded plastic or other suitable materials. The ice bucket dispenser apparatus 10 can easily be disassembled for cleaning or repair.

With continued attention to FIGS. 1 through 4, the upper bucket portion 15 includes an ice bucket 18 with an open bucket top 19. The bucket 18 is insulated by the construction material and the thickness of the preferably generally cylindrical bucket wall. The bucket 18 preferably includes a hollow, dual wall design. The ice bucket walls are preferably filled with an insulating foam or the like during manufacture, so that ice in the bucket can be prevented from melting for a longer time. Once the ice bucket 18 is filled with pieces of ice 12 from a freezer or the like, the open bucket top 19 is preferably covered by a bucket lid 21 as seen in the simplified view of FIG. 4 to help prevent the ice bodies 12 from melting. The bucket lid 21 preferably includes a bucket lid handle 17 on top of the bucket lid.

Separate from the stand portion 16, the bucket 18 can alternatively be used like a conventional ice bucket. For example, the bucket 18 may be used for ice transport and short-term storage or storage of soda cans or other beverages, or containers of food. The dispenser apparatus 10 may optionally include a handle or handles (not shown) on the outside of the bucket 18. Other variations and enhancements are intended to be included herein.

In addition to the ice bucket 18 and the optional bucket lid 21, the bucket portion 15 includes a drain valve 28 in a drain valve opening 29 in the bottom bucket wall 27, an ice cube chute 20, or opening, in the bottom bucket wall 27, and a lower bucket base 30, as shown in FIGS. 1 through 5. The bucket base 30 (see FIG. 3) fits over the bottom bucket wall 27, as seen in FIG. 1, between the bucket 18 and the top of the stand portion 16. The bucket base 30 is ordinarily snapped onto the bucket 18.

Figure 3:
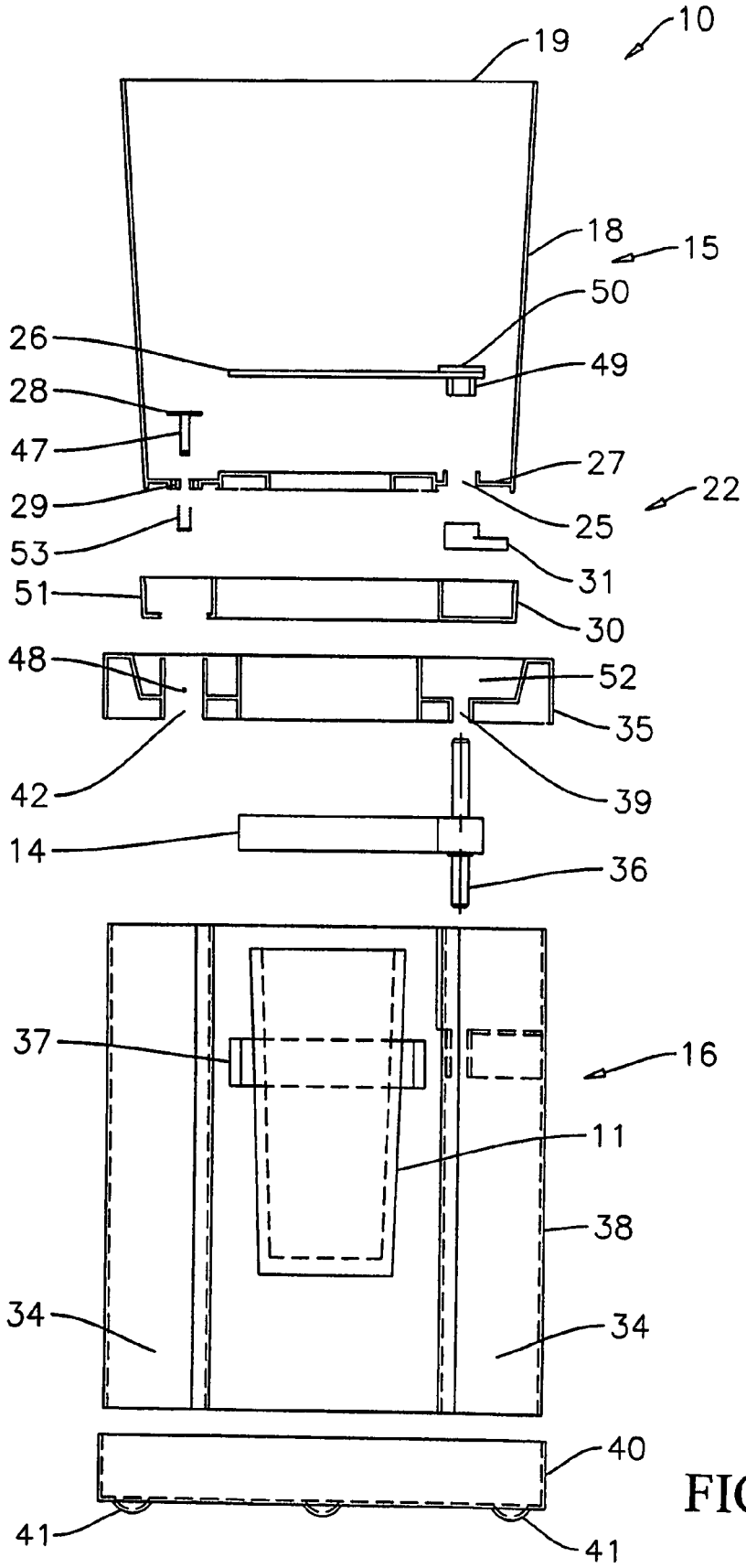
FIG. 3 is an exploded view of the ice bucket dispenser apparatus according to FIG. 1.
Figure 4:
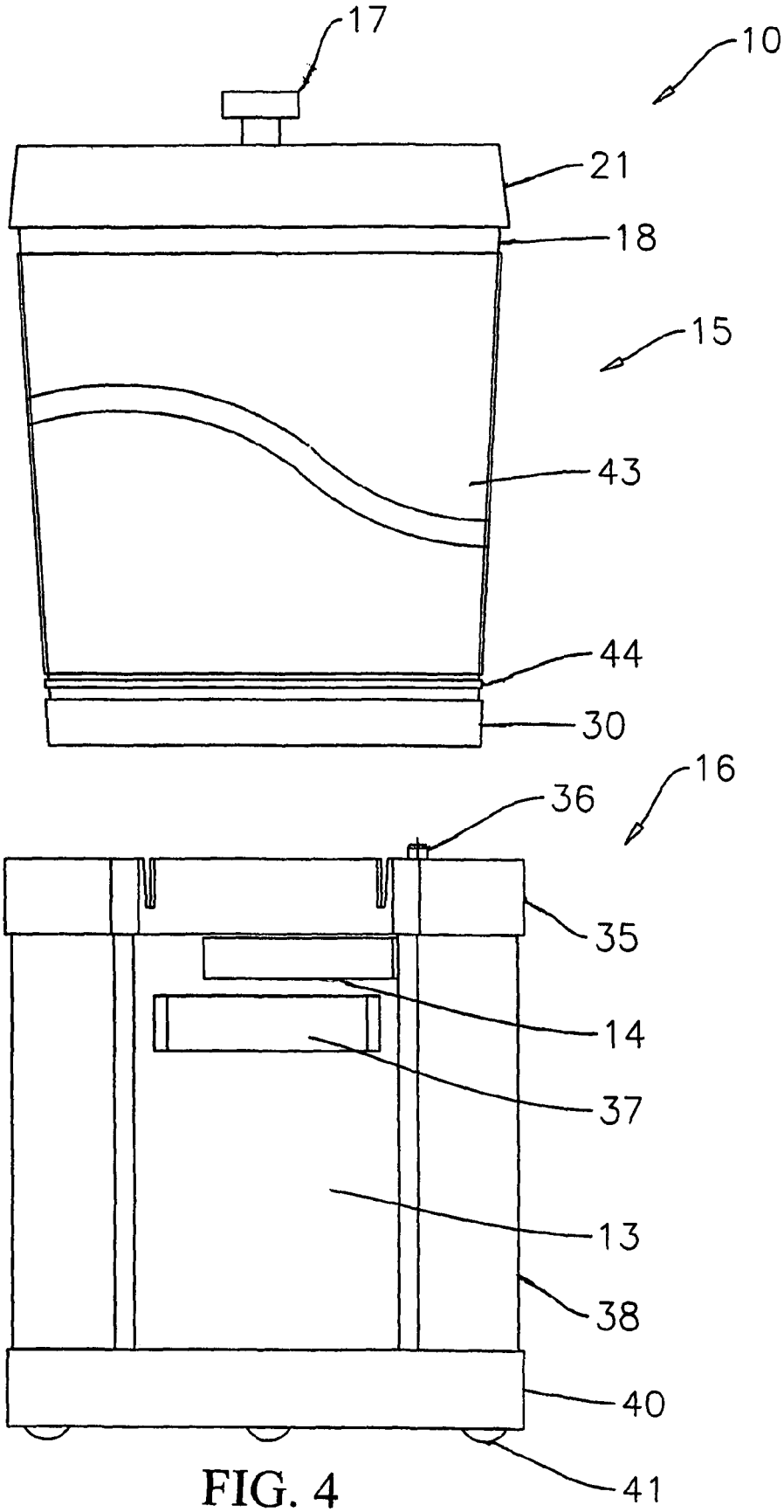
FIG. 4 is a perspective view of an ice bucket dispenser apparatus according to the present invention, shown with the bucket portion detached and without a drinking glass.

The ice bucket dispensing apparatus 10 also includes a dispensing mechanism 22 for dispensing ice from the bucket 18 into the drinking glass or other receptacle 11. The dispensing mechanism 22 comprises a movable gate flap 23 within the bucket 18, a gate shaft cap 24 at one end of the gate flap 23, and a spring-loaded lever 31 beneath the bottom wall of the bucket. The gate shaft cap 24 includes a generally vertically oriented cap stem 49 extending down from a generally horizontally oriented, upper cap crown 50. The cap crown 50 on the upper end of the gate shaft cap 24 prevents the cap stem 49 from sliding through the hole in the gate flap and maintains the gate flap 23 in place. The cap stem 49 extends through a hole in the end of the gate flap 23. The cap stem 49 also extends through a flap screw aperture 25 in the bottom of the bucket 18. The spring-loaded lever 31 receives the lower end of the cap stem 49, as seen in FIGS. 3 and 5, as well as the gate shaft 36.

Figure 5:
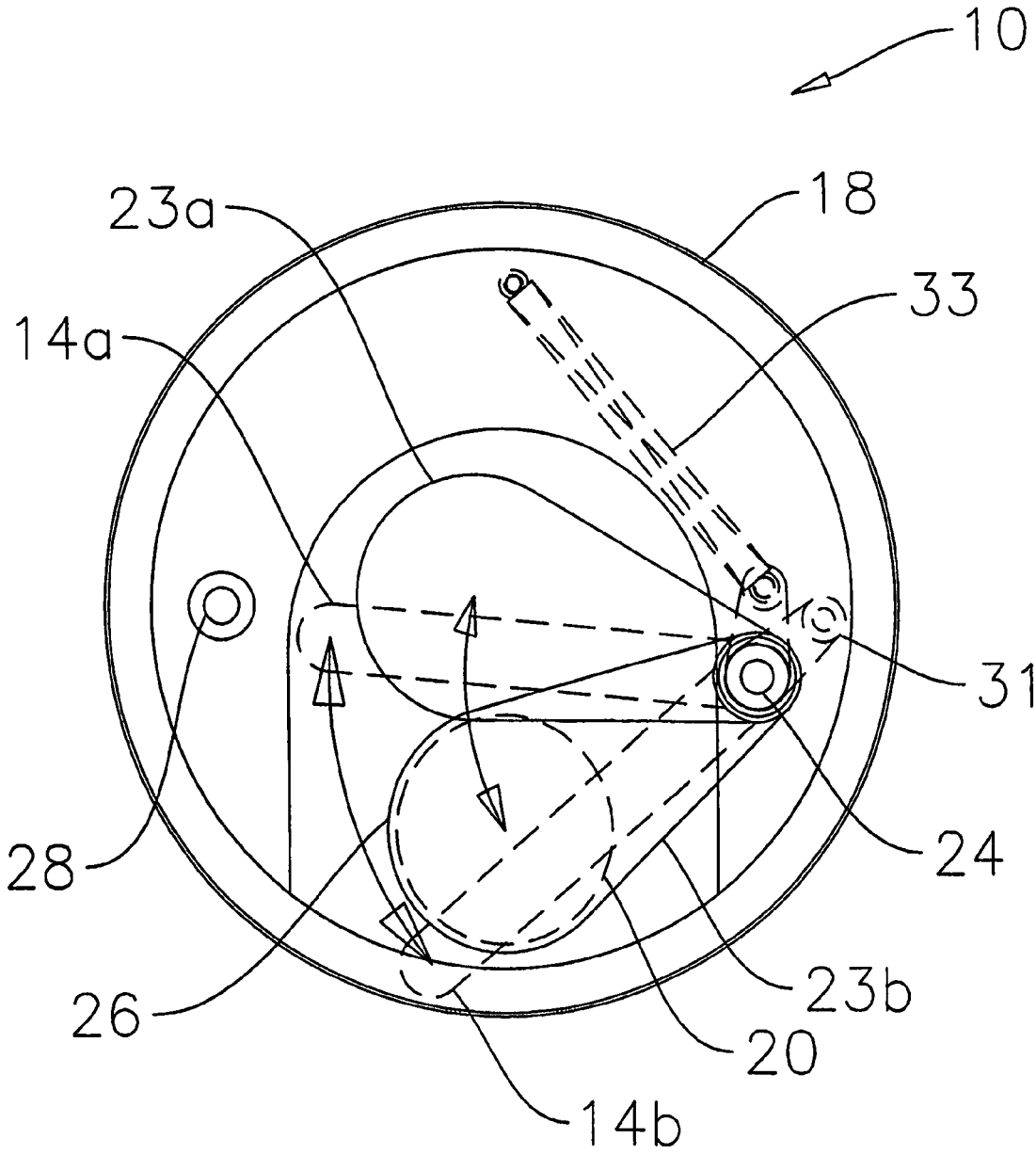
FIG. 5 is a top plan view of an open-topped ice bucket dispenser apparatus according to the present invention, showing the gate flap in different positions.

The opposite, free end 26 of the gate flap 23 is capable of swinging back and forth (in the directions indicated by the two headed arrow in FIG. 5) between a closed flap position over the generally circular opening, or ice chute, 20 (the lower position 23*b* depicted in FIG. 5) and an open flap position next to the ice chute (opening) 20 in the bottom of the bucket 18 (the upper position 23*a* shown in FIG. 5). The cap stem 49 extends perpendicular to the bottom bucket wall, so that the gate flap 23 extends parallel to and above the bottom bucket wall 27 within the bucket 18. The bottom bucket wall is preferably a double wall, most preferably with an insulation-filled space between the two walls.

Figure 8:
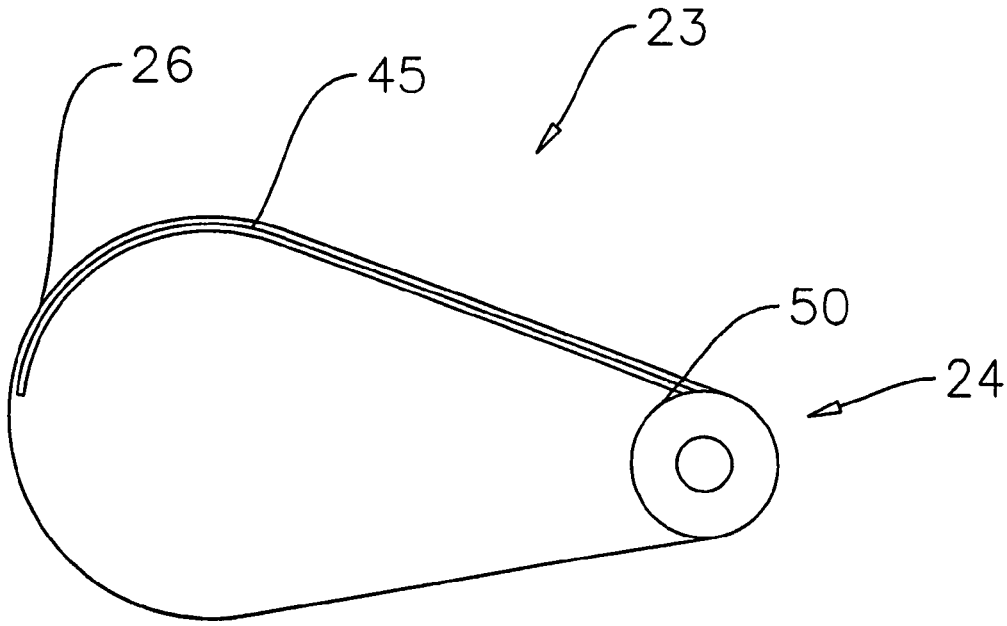
FIG. 8 is a top plan view of an alternate gate flap of an ice bucket dispenser apparatus according to the present invention.
Figure 9:
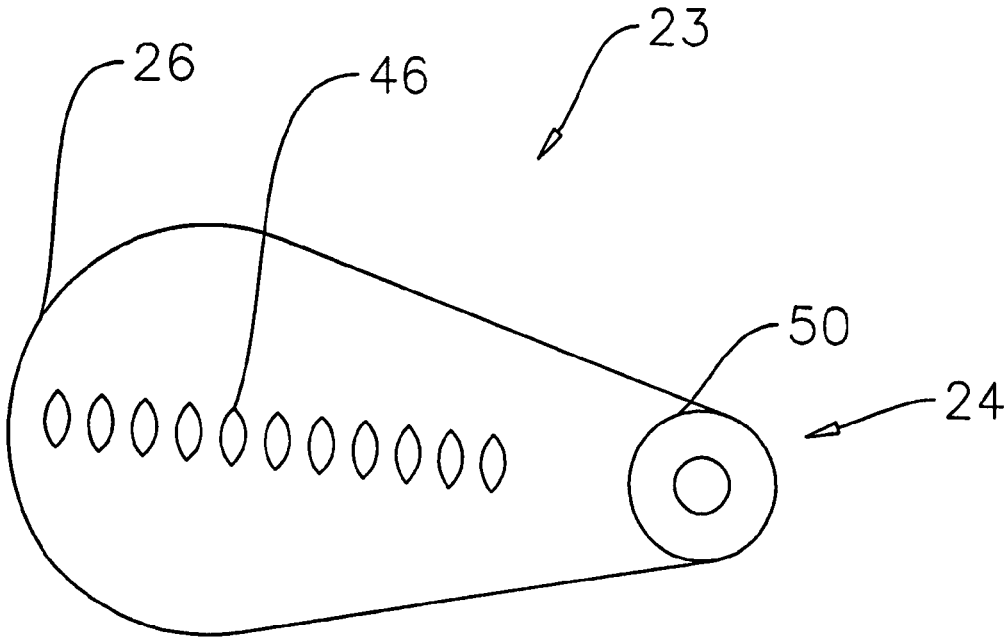
FIG. 9 is a top plan view of an alternate gate flap of an ice bucket dispenser apparatus according to the present invention.

The ice chute opening 20 is ordinarily covered by the gate flap 23, which is its closed position 23*b*. The gate flap 23 is held closed by a gate spring 33, which is located within the double wall bucket bottom. The spring permits the user to operate the dispenser apparatus 10 with one hand, leaving the other hand free to perform other tasks. The gate flap 23 optionally includes a number of protuberances 46 on its upper surface for agitating the ice, as illustrated in FIGS. 8 and 9. The gate flap 23 shown in FIG. 8 has a thickened forward edge 45 for scraping. The gate flap 23 depicted in FIG. 9 alternatively includes a row of protuberances 46 resembling a central spine along a portion of the upper surface of the gate flap 23. Both protuberances 45, 46 are believed to catch and push the ice when the gate flap 23 opens.

Figure 2:
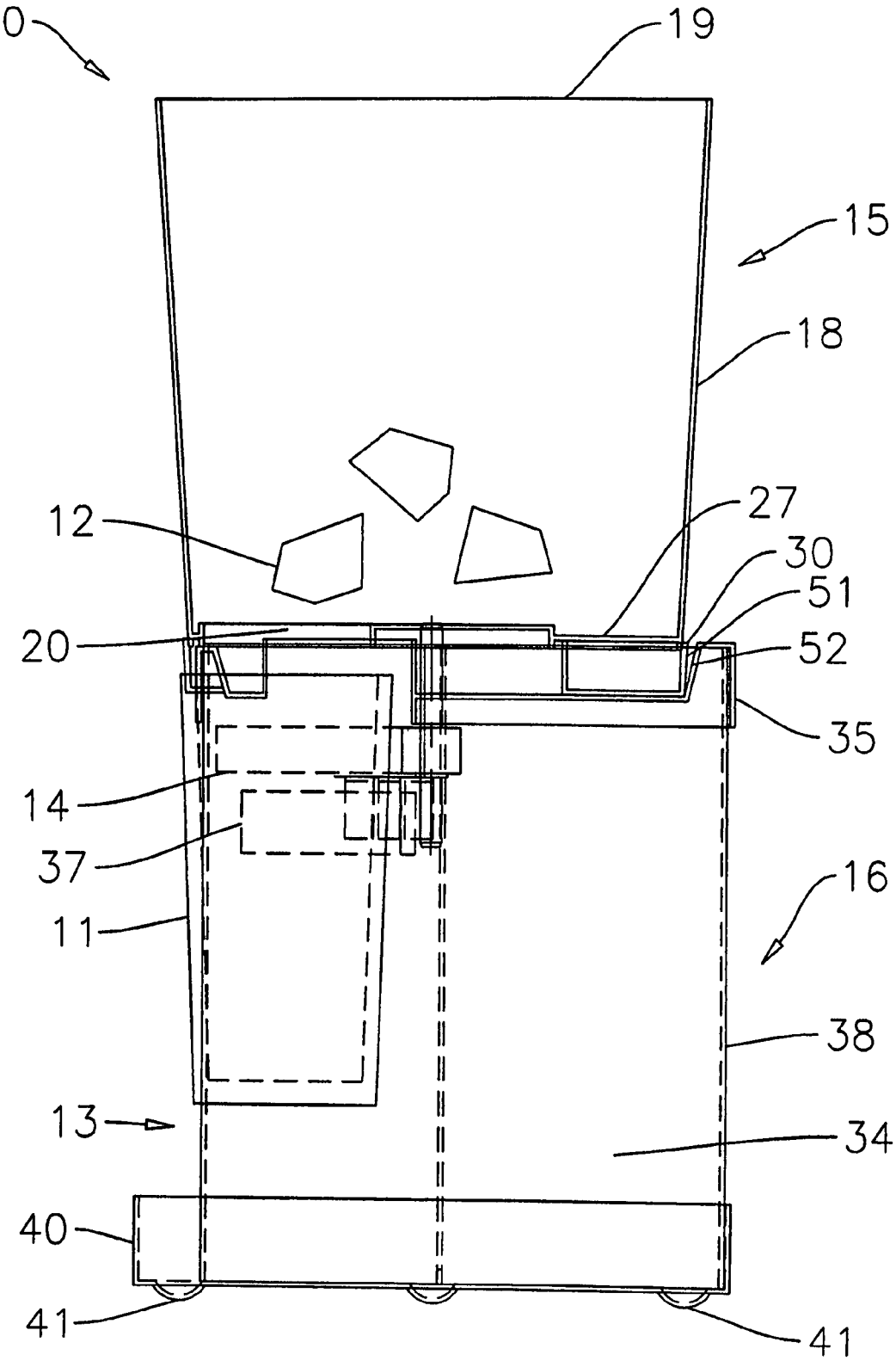
FIG. 2 is a side elevational view of the ice bucket dispenser apparatus according to FIG. 1.

In the stand portion 16, the dispensing mechanism 22 comprises the dispensing lever 14, which is preferably a push lever, with its rotation gate shaft 36, and a tumbler stop/guide 37 (see FIGS. 1, 2, and 5). The stand portion 16 includes the stand body 38 with its dispensing alcove 13, which accommodates the drinking glass or other receptacle 11, and a docking well section 35. The alcove 13 is sized to accommodate various sizes of glasses, cups, tumblers, pitchers, and other receptacles 11 for holding ice. The tumbler stop 37 acts as a guide for the drinking glass or other receptacle 11 and as a The dispensing (push) lever 14 is parallel to the gate flap 23 above it in the bucket 18, and the tumbler stop 37 just below it in the dispensing alcove 13. The gate shaft 36 extends perpendicular to the push lever 14 at one end of the push lever, as seen in FIG. 3. The push lever 14 extends across an upper section of the dispensing alcove 13 so that it can easily be depressed by pushing an upper section of the drinking glass 11 against it. The push lever 14 may be curved to conform to the curved side of the glass or other receptacle 11. The push lever 14 is positioned in the alcove 13 several inches down and away from the ice chute 20 to decrease the likelihood that soiled lips of drinking glasses 11, tumblers, etc. will come in contact with the push lever. Instead, the upper middle section of conventional sized water glasses will normally contact the push lever.

Continuing with the dispensing mechanism 22 shown in FIGS. 1-3 and 7, the rotating dispensing lever 14 is mated to the generally vertically oriented gate shaft 36 that is held within the stand portion 16. The top end of the gate shaft 36 engages the gate flap 23 when the bucket portion 15 is docked to the stand portion 16. In use, the dispensing push lever 14 is pushed and rotated by the hand-held tumbler or other receptacle 11 as it is moved under the ice chute 20. This in turn causes the gate flap 23 to open, which permits ice to drop into the tumbler. As the tumbler is removed, the gate flap 23 closes. The dispensing push lever 14 and gate spring 33 permit one-handed use. The dispensing push lever 14 rotates in a circular manner to activate the gate flap 23. The gate flap 23 and gate shaft 36 may be made of a water-resistant metal material.

Figure 6:
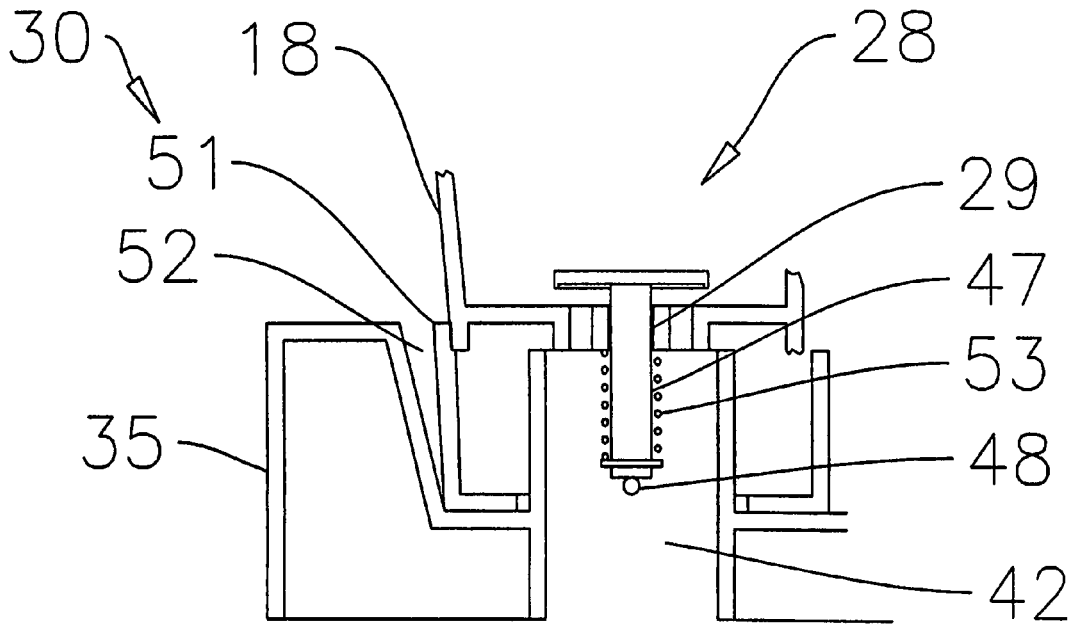
FIG. 6 is a cross-sectional view of a middle section of an ice bucket dispenser apparatus according to the present invention, showing a front left side of the apparatus.
Figure 7:
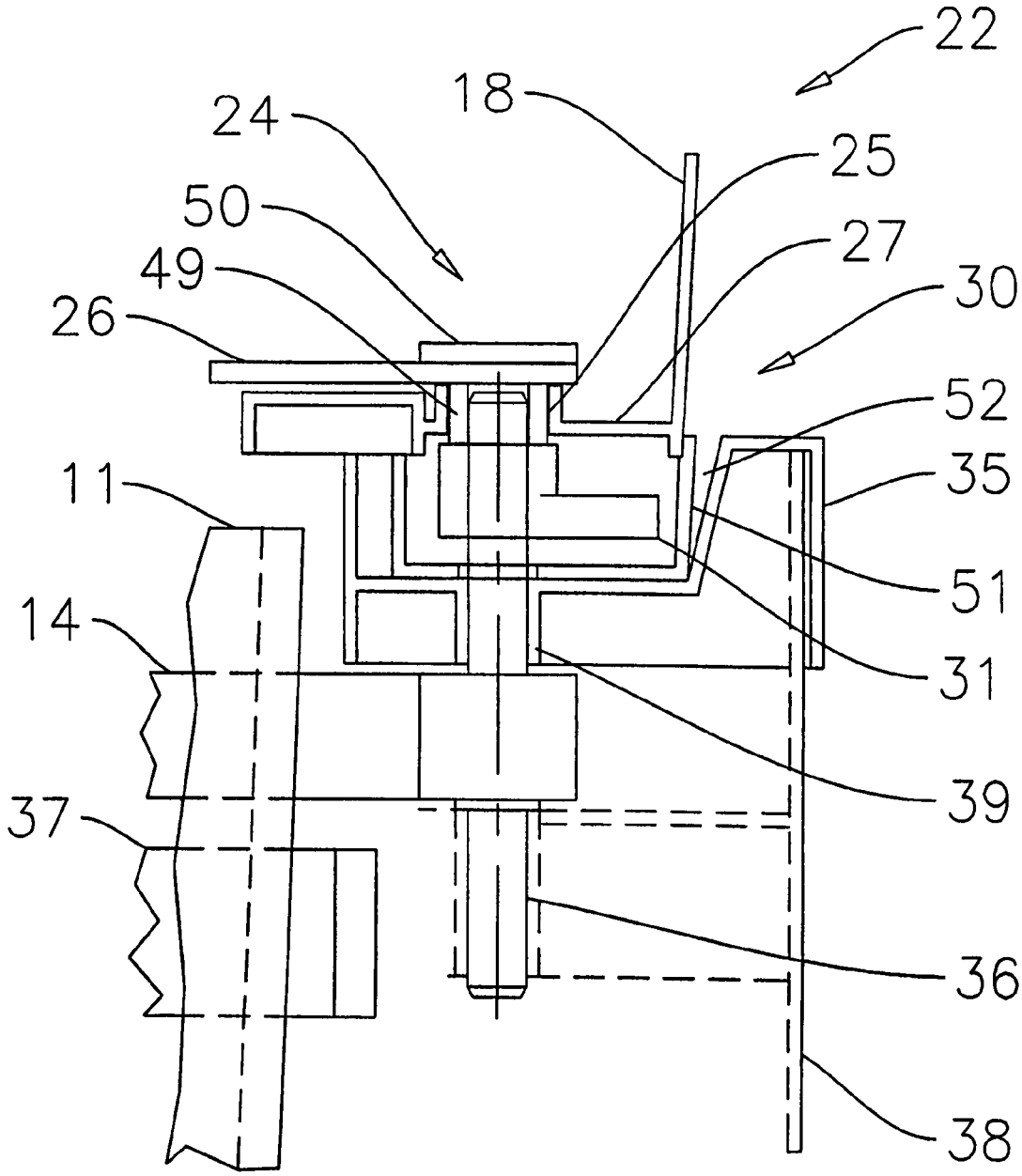
FIG. 7 is a cross-sectional view of a portion of a dispensing mechanism of an ice bucket dispenser apparatus according to the present invention, showing a front right middle section of the apparatus.

In the stand portion 16, the permanently mounted docking well section 35 fits closely over the top of the stand body 38, with the gate shaft 36 extending through a gate shaft aperture 39 in the docking well section 35. The bottom of the permanently mounted bucket base 30 detachably mates with the top of the docking well section 35, as seen in FIGS. 1, 6, and 7. The docking well section 35 has a greater diameter than the bucket base 30. The periphery 51 (edge) of the generally circular-shaped bucket base 30 docks in a generally circular-shaped, shallow docking well 52 in the generally circular-shaped docking well section 35, as seen in FIGS. 3, 6, and 7.

The stand portion 16 has many functions. It supports the bucket portion 15 in the docking well section 35 at the top of the stand portion 16. The stand portion 16 includes the push lever 14 and its rotation gate shaft 36. The tumbler stop and guide 37 in the dispensing alcove 14 positions tumblers under the ice chute 20.

As shown in FIGS. 5 and 7, the dispensing mechanism 22 comprises the gate flap 23, the gate shaft cap 24, the dispensing lever 14, the gate shaft 36, the spring lever 31, and the gate spring 33. The dispensing lever 14 and gate shaft 36 are resident in the stand portion 16 of the apparatus 10. The gate flap 23, gate shaft cap 24, spring lever 31, and gate spring 33 are resident within the bucket portion 15 of the apparatus. The gate flap 23, the shaft cap 24, and the spring lever 31 are preferably bonded together during manufacturing. The generally horizontally oriented gate flap 23 rotates about the vertical axis of the gate shaft 36 to cover or uncover the ice chute 20. As the bucket portion 15 is docked with the stand portion 16, the gate shaft 36 slides into the spring-loaded lever 31 and the gate shaft cap 24. Anti-rotation features in the spring lever 31 and the dispensing lever 14, such as a square or non-round hole, mate with corresponding features on the gate shaft 36.

Continuing with the dispensing mechanism illustrated in FIGS. 5 and 7, gate spring 33, which is an extension-type spring, is located within the double-walled bottom of the bucket 18. The gate spring 33 is connected to the spring-loaded lever 31, which is coupled to the gate shaft 36. The opposite end of gate spring 33 is preferably attached to a molded feature within the double-walled bucket bottom. The gate spring 33 pulls the spring-loaded lever 31, which applies torque via gate shaft 36 sufficient to close the gate flap 23 and return the dispensing lever 14 to its forwardmost position. As the dispensing lever 14 is pushed in, the gate shaft 36 rotates. This causes the gate flap 23 to uncover the ice chute 20.

Alternatively, the gate spring 33 can be located in the stand portion 16 of the apparatus, or a torsion spring can be used around the gate shaft in place of an extension spring. Also, one spring can alternatively be located in the bucket portion 15 with a second spring in the stand portion 16. If only one spring is used, some detent feature is added to either the gate flap 23 or the dispensing lever 14 to keep the components in proper position when the bucket portion 15 is removed from the stand portion 16.

The ice bucket dispenser apparatus 10 includes a water drainage and collection system 32 that includes the drain valve 28 in the bottom wall 27 of the bucket 18, and the reservoir 34 within the stand body 38. The bucket bottom wall 27 is preferably double walled. The drain valve 28 is preferably a spring-closed poppet-type valve that extends through the bottom wall 27 of the bucket 18, as seen in FIGS. 1, 3, and 6. A drain valve aperture 42 in the docking well 52 accommodates the drain valve 28 (see FIGS. 3 and 6). The gate shaft aperture 39 is located at the bottom of the docking well 52, as is the drain valve aperture 42. The gate shaft aperture 39 and drain valve aperture 42 are on opposite sides of the docking well section 35.

The drain valve 28 opens automatically when the bucket portion 15 is docked with the stand portion 16. Drain water is routed to the generally C-shaped reservoir 34. The dispensing alcove 13 provides the reservoir 34 its generally C-shaped appearance in transverse cross-section. If the dispensing alcove 13 was not present, the reservoir 34 would be cylindrical in shape.

The drain valve 28 automatically closes as the bucket portion 15 is removed from the stand portion 16. Since the drain valve 28 is closed when the bucket portion 15 is not docked on the stand portion 16, leaks are minimized. Accumulated melt water is held in the reservoir 34 out of sight of guests and other on-lookers. Melt water is unlikely to drain on the guests' clothes, the countertop, the surrounding floor, etc. The stand body 38 can periodically be removed, and the reservoir 34 can be emptied and cleaned, as desired. The components of the ice bucket dispenser apparatus 10 are detachable for cleaning after use.

As seen in cross-section in FIGS. 3 and 6, the drain valve 28 includes a drainage valve spring 53 and a generally vertically oriented valve pin 47. When the bucket portion 15 is docked on the stand portion 16, the tip of the generally vertically oriented valve pin 47 strikes a generally horizontally oriented pin 48 that extends across the drain valve aperture 42. The generally horizontally oriented pin 48 is preferably a spring pin, dowel pin, or a roll pin. When docked, this pushes the generally vertically oriented pin 47 up. In use, once the bucket portion 15 is docked on the stand portion 16, the poppet-type drain valve 28 springs up and remains open. This permits water to flow into the reservoir 34, and solves the melt water problem. Once the bucket portion 15 is removed from the stand portion 16, the coil spring 53 pulls down the drain valve 28 prevents water from flowing through the drain valve.

As seen in FIGS. 1-4, the dispenser apparatus 10 further includes a base 40, which supports the stand portion 16. The base is permanently mounted at the bottom of the stand portion. The bottom of the glass 11 or other receptacle in the dispensing alcove 13 can be seated on the top of the base 40, if desired (see FIG. 2).

Optionally, a number of feet 41, preferably four feet, on the bottom of the base 40 of the stand portion 16 support the ice bucket dispenser apparatus 10 on the countertop or other relatively flat surface. The feet 41 help to prevent wobbling and sticking of the stand portion 16 to the countertop. The feet 41 may be tipped with rubber or a nonskid coating to help prevent the apparatus 10 from sliding on the countertop.

The bucket portion 15 is designed to accommodate a decorative sleeve 43. The decorative sleeve made of plastic, metal, etc. can be slid onto or wrapped around the outside of the bucket portion 15 to change its image. The cylindrical-shaped, bottomless, decorative sleeve 43 substantially covers the bucket portion 15. The bucket portion 15 may include a thin ledge 44 at the juncture of the bucket 18 and the bucket base 30, which holds the decorative sleeve in place. The decorative sleeve 43 may be printed with various designs and colors. The decorative sleeve may display sports team or party and holiday themes. Different decorative sleeves may be used for different occasions.

No augers, cranks or paddlewheels are required in the present invention. The ice bucket dispenser apparatus 10 is manually operated and does not have a motor. The ice bucket dispenser apparatus 10 is not connected to a refrigeration unit or an electrical source.

From the foregoing it can be realized that the described device of the present invention may be easily and conveniently utilized as an ice bucket dispenser. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 ice bucket dispenser apparatus
11 glass/receptacle
12 ice bottles
13 dispensing alcove
14 dispensing lever
15 bucket portion
16 stand portion
17 bucket lid handle
18 bucket
19 bucket top opening
20 ice chute
21 bucket lid
22 dispensing mechanism
23 gate flip
24 gate flap opening
25 gate flap opening
26 free end of gate flap
27 bottom bucket wall
28 drain value
29 drain valve opening
30 bucket base
31 spring lever
32 drainage & collection system
33 gate spring
34 reservoir
35 docking well section
36 gate shaft
37 tumbler stop
38 stand body
39 gate shaft aperture
40 base
41 feet
42 drain valve aperture
43 decorative sleeve
44 sleeve ledge
45 gate flap thickened edge
46 gate flap protuberance
47 generally vertical valve pin
48 generally horizontal pin
49 cap stem
50 cap crown
51 bucket base edge
52 docking well
53 drain valve spring

What is claimed is:

1. A portable ice bucket apparatus for storing and dispensing ice, the apparatus comprising:

(a) an upper bucket portion comprising an insulated bucket with an opening at the top of the bucket and an ice body chute opening in a bottom wall of the bucket;

(b) a motorless lower stand portion, the upper bucket portion being detachably attachable to the lower stand portion;

(c) a dispensing mechanism comprising a movable gate flap within the upper bucket portion, a spring-loaded lever, and a gate shaft and a dispensing lever within the stand portion, the dispensing lever being coupled to the gate shaft, the gate shaft being coupled to the spring-loaded lever, the gate shaft being coupled with the gate flap; and (d) a water drainage and collection mechanism comprising a reservoir in the stand portion;

wherein the movable gate flap in a closed position substantially covers the ice body chute opening; and wherein the dispensing mechanism further comprises a gate shaft cap and a gate spring, the gate flap, the gate shaft cap, the spring-loaded lever and the gate spring being within the bucket portion.

2. The apparatus according to claim 1, wherein the water drainage and collection mechanism further comprises a drain valve extending through the opening in the bottom wall of the upper bucket portion; and wherein the drain valve is in an open position when the upper bucket portion is attached to the stand portion, and in a closed position when the upper bucket portion is not attached to the stand portion.

3. The apparatus according to claim 2, wherein the movable gate flap in an open position does not cover the ice body chute opening.

4. A portable ice bucket apparatus for storing and dispensing ice, the apparatus comprising: (a) an upper bucket portion comprising an insulated bucket with an opening at the top of the bucket and an ice body chute opening in a bottom wall of the bucket; (b) a motorless lower stand portion, the upper bucket portion being detachably attachable to the lower stand portion; (c) a dispensing mechanism comprising a movable gate flap within the upper bucket portion, a spring-loaded lever, and a gate shaft and a dispensing lever within the stand portion, the dispensing lever being coupled to the gate shaft, the gate shaft being coupled to the spring-loaded lever, the gate shaft being coupled with the gate flap; and (d) a water drainage and collection mechanism comprising a reservoir in the stand portion; wherein the movable gate flap in a closed position substantially covers the ice body chute opening; and wherein the dispensing mechanism further comprises a gate shaft cap and a gate spring, the gate flap, the gate shaft cap, the spring-loaded lever and the gate spring being within the bucket portion, the gate shaft sliding into the spring-loaded lever and the gate shaft cap when the bucket portion is docked with the lower stand portion.

5. The apparatus according to claim 4, wherein the movable gate flap is within the bucket, the gate shaft cap comprising an upper cap crown on a cap stem, the generally vertically oriented cap stem extending down from the generally horizontally oriented, upper cap crown, the cap stem extending through a hole in one end of the gate flap, the cap stem extending through a flap screw aperture in the bottom of the bucket.

6. The apparatus according to claim 5, wherein the bottom wall of the bucket portion is double-walled and holds the gate spring, the gate spring being connected to the spring-loaded lever, the spring-loaded lever receiving a lower end of the cap stem.

7. The apparatus according to claim 6, wherein an opposite end of the gate spring is attached to a molded feature within the double-walled bucket bottom.

8. The apparatus according to claim 4, wherein an upper end of the generally vertically oriented gate shaft is coupled with the generally horizontally oriented gate flap; the gate flap rotating about a vertical axis of the gate shaft.

9. The apparatus according to claim 4, wherein the stand portion further comprises an ice dispensing alcove, the dispensing lever being accessible to a receptacle placed in the ice dispensing alcove.

10. The apparatus according to claim 4, wherein anti-rotation features in the spring-loaded lever and the dispensing lever mate with corresponding features on the gate shaft.

11. The apparatus according to claim 4, wherein when the gate spring pulls the spring-loaded lever, the gate shaft moves the gate flap to the closed position covering the ice chute opening and returns the dispensing lever to a forward position.

12. The apparatus according to claim 8, wherein the gate shaft rotates when the dispensing lever is pushed in, which moves the gate flap to an open position away from the ice chute opening.

13. The apparatus according to claim 1, wherein the apparatus is not connected to a refrigeration unit, or a source of electricity.

14. The apparatus according to claim 4, wherein the drainage and collection system further comprises a generally horizontally oriented pin extending across a drain valve aperture in a docking well of the lower stand portion; the drain valve comprising a drainage valve spring and a generally vertically oriented valve pin; an end of the generally vertically oriented valve pin being in contact with the generally horizontally oriented pin when the bucket portion is docked on the lower stand portion.

15. The apparatus according to claim 14, wherein the drainage valve spring returns the drainage valve pin to a down position once the bucket portion is removed from the stand portion, which closes the drainage valve.

16. The apparatus according to claim 14, wherein the drainage valve aperture opens to the reservoir, so that melt water flowing through the drainage valve when it is in an open position collects in the reservoir.

17. The apparatus according to claim 9, wherein the stand portion further comprises a base for supporting a bottom of the receptacle in the ice dispensing alcove, the base comprising a plurality of feet.

18. The apparatus according to claim 4, further comprising a removable decorative sleeve substantially covering an outside of the bucket portion.

19. The apparatus according to claim 4, wherein the gate flap comprises a thickened forward edge.

20. The apparatus according to claim 4, wherein the gate flap comprises a plurality of spine-like protuberances on a portion of an upper surface of the gate flap.

* * * * *